US008785801B2

(12) United States Patent
Kim

(10) Patent No.: US 8,785,801 B2
(45) Date of Patent: Jul. 22, 2014

(54) DUAL STRUCTURED CONTACT FOR SWITCHGEAR AND SWITCHGEAR HAVING THE SAME

(75) Inventor: Hyung Choon Kim, Ulsan (KR)

(73) Assignee: Hyundai Heavy Industries Co., Ltd., Ulsan (KR)

( * ) Notice: Subject to any disclaimer, the term of this patent is extended or adjusted under 35 U.S.C. 154(b) by 187 days.

(21) Appl. No.: 13/452,233

(22) Filed: Apr. 20, 2012

(65) Prior Publication Data

US 2013/0048476 A1 Feb. 28, 2013

(30) Foreign Application Priority Data

Aug. 24, 2011 (KR) ..... 10-2011-0084638

(51) Int. Cl.
*H01H 3/00* (2006.01)
*H01H 1/38* (2006.01)

(52) U.S. Cl.
CPC ..... *H01H 1/385* (2013.01)
USPC ..... 218/7; 218/57

(58) Field of Classification Search
None
See application file for complete search history.

(56) References Cited

U.S. PATENT DOCUMENTS

| | | | | |
|---|---|---|---|---|
| 3,621,170 | A * | 11/1971 | Jensen | 218/48 |
| 3,909,573 | A * | 9/1975 | Wilson | 200/258 |
| 8,232,496 | B2 * | 7/2012 | Granhaug et al. | 218/18 |
| 2005/0236371 | A1 | 10/2005 | Cameroni et al. | |
| 2007/0068903 | A1 * | 3/2007 | Hashimoto et al. | 218/57 |
| 2007/0221626 | A1 | 9/2007 | Uchii | |
| 2007/0246444 | A1 * | 10/2007 | Saxl et al. | 218/16 |
| 2009/0314745 | A1 * | 12/2009 | Granhaug et al. | 218/7 |
| 2010/0075520 | A1 * | 3/2010 | Hughes et al. | 439/181 |
| 2011/0180514 | A1 | 7/2011 | Jin | |
| 2012/0280772 | A1 * | 11/2012 | Fujita et al. | 335/207 |

FOREIGN PATENT DOCUMENTS

KR 10-20110084638 A 7/2011

* cited by examiner

*Primary Examiner* — Truc Nguyen
(74) *Attorney, Agent, or Firm* — Sherr & Jiang, PLLC

(57) ABSTRACT

Provided is a dual structured contact for switchgear, which includes a moving contact unit being formed of a conducting material, the moving contact unit including first and second terminals, the first terminal comprising a cylinder and the second terminal extending to a driving unit such that the moving contact unit moves back and forth by the driving unit, and a fixing contact unit being formed of a conducting material, the fixing contact unit including first and second cylinders being outside and inside of the fixing contact unit with same axis, an inner part of the first cylinder being in contact with an outer part of the first terminal, and an outer part of the second cylinder being in contact with an inner part of the first terminal.

5 Claims, 7 Drawing Sheets

DUAL STRUCTURED CONTACT FOR SWITCHGEAR AND SWITCHGEAR HAVING THE SAME

CROSS-REFERENCE TO RELATED APPLICATIONS

This application claims foreign priority under 35 U.S.C. §119 to Korean Patent Application No. 10-2011-0084638 filed Aug. 24, 2011 with the Korean Intellectual Property Office, which is hereby incorporated by reference in its entirety.

BACKGROUND

1. Field of the Invention

The present invention relates to a contact used in switchgear and, more particularly, to a dual structured contact for switchgear.

2. Description of Related Art

In an electric power system, switchgear, especially GIS (Gas Insulated Switchgear), is used for a power plant or a substation. In fault conditions such as short circuits and overload fault currents, the switchgear provides isolation of circuits from power supplies to protect power systems while maintaining service to unaffected circuits.

In general, the switchgear includes a circuit breaker, a disconnecting switch, a ground switch, and so on. Herein, the disconnecting switch may be categorized into, but not limited to, a line disconnecting switch and a busbar disconnecting switch and may be used for the isolation under fault conditions or carrying out the maintenance work without disturbing the unaffected circuits.

The disconnecting switch may include a large number of components such as finger springs, shields, contacts, conductors, and so on. Therefore, the size of the switchgear may be large and the cost of the switchgear may be higher.

SUMMARY

To address the above-discussed problems occurring in the prior art, aspects of the present invention provide a dual structured contact used in a switchgear (e.g, disconnecting switch), thereby reducing thickness of contact and increasing stableness of fault conditions.

In some embodiments, a dual structured contact for switchgear includes a moving contact unit being formed of conducting material, the moving contact unit including first and second terminals, the first terminal being formed of cylinder and the second terminal being extended to a driving unit such that the moving contact unit moves back and forth by the driving unit and a fixing contact unit being formed of conducting material, the fixing contact unit including first and second cylinders being outside and inside of the fixing contact unit with a same axis, an inner part of the first cylinder being in contact with an outer part of the first terminal and an outer part of the second cylinder being in contact with an inner part of the first terminal.

The fixing contact unit may further include at least one pair of spring contact members, each being subsided in the first and second cylinders and being configured to be in direct contact with the moving contact unit to flow currents therethrough.

The at least one pair of spring contact members includes a first spring contact pair being fixed by subsidence inner of the first cylinder, and a second spring contact pair being fixed by subsidence outer of the second cylinder.

A central axis of the first spring contact pair is not the same as that of the second spring contact pair.

In some embodiments, a switchgear includes a disconnecting switch including a dual structured contact with a moving contact unit and a fixing contact unit, wherein the moving contact unit is formed of conducting material and the moving contact unit includes first and second terminals, the first terminal being formed of a cylinder and the second terminal being extended to a driving unit such that the moving contact unit moves back and forth by the driving unit and wherein the fixing contact unit is formed of conducting material and the fixing contact unit includes first and second cylinders being outside and inside of the fixing contact unit with the same axis, an inner part of the first cylinder being contact with an outer part of the first terminal and an outer part of the second cylinder being in contact with an inner part of the first terminal.

Accordingly, the dual structured contact for switchgear according to embodiments of the present invention reduces length and thickness to minimize the switchgear.

The dual structured contact for a switchgear may provide stableness of fault conditions such as short circuits and overload fault currents.

Figure 1:
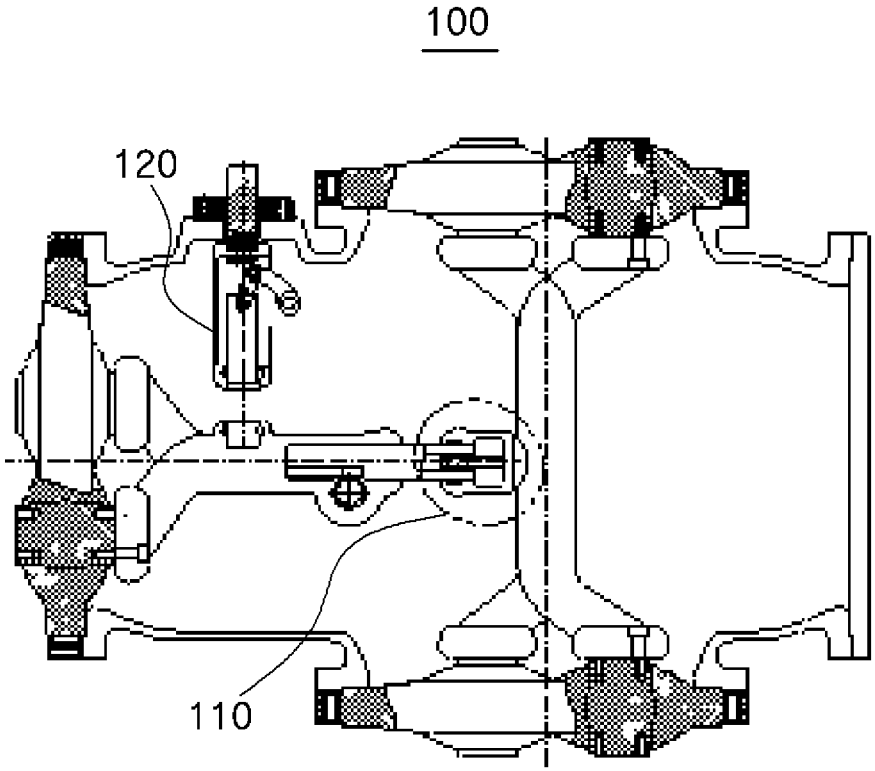
FIG. 1 is a sectional view illustrating a busbar disconnecting switch in a GIS (Gas Insulated Switchgear) according to an example embodiment of the present invention.

The drawings are not necessarily to scale. The drawings are merely schematic representations, not intended to portray specific parameters of the invention. The drawings are intended to depict only typical embodiments of the invention, and therefore should not be considered as limiting the scope of the invention. In the drawings, like numbering represents like elements.

DETAILED DESCRIPTION

Reference will now be made in greater detail to preferred embodiments of the invention, examples of which are illustrated by the accompanying drawings.

Since descriptions of the disclosed technology are only presented to describe embodiments whose purpose is to describe the structures and/or functions of the present invention, it should not be concluded that the scope of the rights of the disclosed technology is limited by the embodiments described herein. That is, the embodiments may be modified in various ways and, therefore, it should be understood that the scope of the rights of the disclosed technology may include equivalents which can implement the technical spirit of the present invention. Furthermore, since objects or advantages presented in connection with the disclosed technology do not require that a specific embodiment should fulfill all of them or only one of them, it should not be concluded that the scope of the rights of the disclosed technology is limited by the presented objects and advantages.

Meanwhile, the meanings of terms described herein should be construed as follows:

The terms "first" and "second" are only used to distinguish one element from another element, and the scope of the rights of the disclosed technology should not be limited by these terms. For example, a first element may be designated as a second element, and similarly the second element may be designated as the first element.

When it is described that one element is "connected" or "coupled" to another element, the one element may be directly connected or coupled to another element, but an intervening element may exist therebetween. On the other hand, when it is described that one element is "directly connected" or "directly coupled" to another element, it should be understood that no element exists therebetween. Meanwhile, other expressions which describe the relationships between elements, that is, "between ~" and "directly between ~" or "adjacent to ~" and "directly adjacent to ~," should be interpreted in the same way.

It should be understood that a singular expression may include a plural expression, as long as the context of the expressions is not obviously different. In this application, the meaning of "include" or "have" are intended to specify a property, a fixed number, a step, a process, an element, a component, and/or a combination thereof but are not intended to exclude the presence or addition of other properties, fixed numbers, steps, processes, elements, components, and/or combinations Reference characters (for example, a, b, c, etc.) related to steps are used for convenience of description, and are not intended to describe the sequence of the steps. The steps may occur in different sequences, as long as a specific sequence is not specifically described in the context. That is, the steps may occur in a specified sequence, may occur simultaneously, or may be performed in the reverse sequence.

Reference throughout this specification to "one embodiment," "an embodiment," "embodiments," or similar language means that a particular feature, structure, or characteristic described in connection with the embodiment is included in at least one embodiment of the present invention. Thus appearances of the phrases "in one embodiment," "in an embodiment," "in embodiments" and similar language throughout this specification may, but do not necessarily, all refer to the same embodiment.

All the terms used herein have the same meanings as terms that are generally understood by those having ordinary knowledge in the art to which the disclosed technology pertains, as long as the terms are defined differently. It should be understood that the terms defined in generally-used dictionaries have meanings coinciding with those of terms in the related technology. As long as the terms are not defined obviously in the present application, they are not ideally or excessively analyzed as having a formal meaning.

The GIS (Gas Insulated Switchgear) may have various components such as a busbar, a busbar disconnecting switch, a current transformer, a circuit breaker, a repair ground switch, a line disconnecting switch and a bushing in a grounded metal housing. The GIS may form a conducting line with the various components and may use an insulation gas (e.g., SF6) for superior insulating performance and arc-extinguishing performance in the grounded metal housing.

The busbar is a main current flowing path and the current transformer may transform currents flown from the busbar. The busbar disconnecting switch may disconnect circuits in a quiescent state and, for example, may disconnect circuits from the busbar to the current transformer. That is, the disconnecting switch may instantly operate in fault conditions to disconnect circuits. The repair ground switch may ground a line in the fault conditions and the line disconnecting switch may disconnect circuits for take-over in transformer equipment.

FIG. 1 is a sectional view illustrating a busbar disconnecting switch in a GIS (Gas Insulated Switchgear) according to an example embodiment of the present invention.

Referring to FIG. 1, a GIS 100 includes a busbar disconnecting switch 110 and a ground switch 120.

The busbar disconnecting switch 110 may include a moving contact unit and a fixing contact unit as described below with respect to FIG. 2. The moving contact unit moves back and forth to be in contact or non-contact with the fixing contact unit, thereby the busbar may be in a current applying state or current shutdown state.

A dual structured contact according to an example embodiment of the present invention may be embodied in the busbar disconnecting switch 110 in FIG. 1. The dual structured contact may reduce thickness of the moving contact unit and may provide better stableness of contacting of the moving contact unit with the fixing contact unit. Herein, the dual structured contact will be described with reference to FIGS. 2 through 7.

Figure 2:
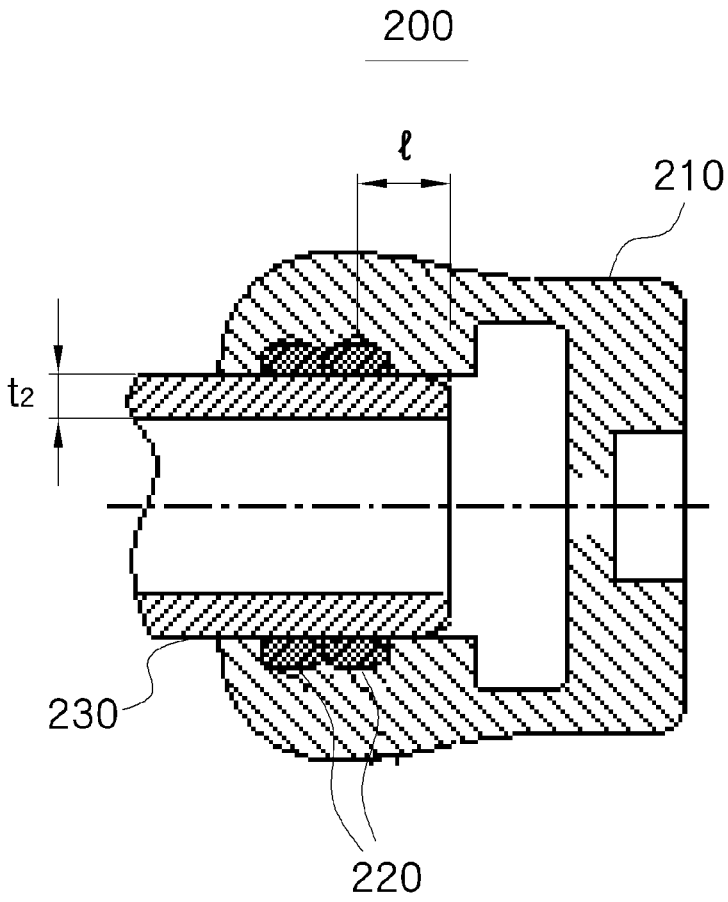
FIG. 2 is a sectional view illustrating a linkage between a fixing contact unit and a moving contact unit in a single structured contact.

FIG. 2 is a sectional view illustrating a linkage between a fixing contact unit and a moving contact unit in a single structured contact.

In FIG. 2, the single structured contact 200 includes a fixing contact unit 210, a contact member 220 and a moving contact unit 230.

When a moving contact unit 230 is inserted into a fixing contact unit 210, currents are applied through the contact member 220. Herein, the contact member 220 may be implemented as a spring contact, and the number of the spring contact may be equal to or more than 2 for efficiency.

In general, the moving contact unit 230 may determine its size according to short circuit currents and regular currents. In FIG. 2, the contact member 220 is implemented as a dual spring contact. A length l should be sufficiently long for stable contact with the moving contact unit 210. This is because unstable contact should be avoided due to thermal expansion in the case where regular currents are applied. Also, a thickness t2 should be sufficiently thick for reducing heat dissipation due to skin effect, i.e., the tendency of an electric current to distribute itself near the surface of a conductor. Therefore, in the single structured contact of FIG. 2, the length l should be long for stable contact, while the thickness t2 should be thick for heat dissipation. Therefore, the single structured contact should guarantee sufficient length l and thickness t2.

Figure 3:
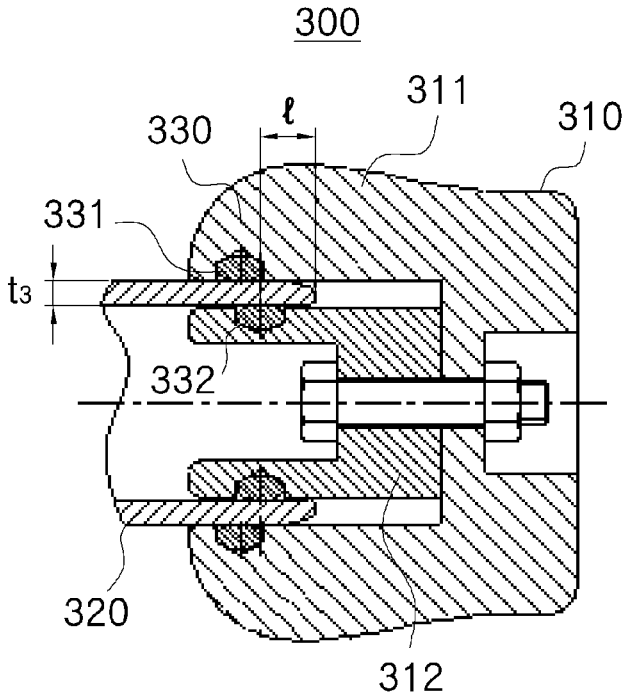
FIG. 3 is a sectional view illustrating a linkage between a fixing contact unit and a moving contact unit in a dual structured contact according to an example embodiment of the present invention.

FIG. 3 is a sectional view illustrating a linkage between a fixing contact unit and a moving contact unit in a dual structured contact according to an example embodiment of the present invention.

Referring to FIG. 3, a dual structured contact 300 includes a fixing contact unit 310 and a moving contact unit 320.

The fixing contact unit 310 has a dual structure with first and second cylinders 311 and 312, wherein both sides (i.e., inner and outer parts) of the moving contact unit 320 may be in contact with the fixing contact unit 310. Hereinafter, the fixing and moving contact units 310 and 320 will be described in more detail.

The fixing contact unit 310 is formed of a conducting material and includes first and second cylinders 311 and 312.

The first and second cylinders 311 and 312 are respectively outside and inside of the fixing contact unit 310, which shares the same axis. Inner of the first cylinder 311 is in contact with outer of a first terminal of the moving contact unit 320 and outer of the second cylinder 312 is in contact with inner of the first terminal of the moving contact unit 320.

The moving contact unit 320 is formed of a conducting material and includes first and second terminals (i.e., front and rear terminals). The first terminal is formed of cylinder and the second terminal is extended to a driving unit (not shown) such that the moving contact unit 320 moves back and forth by the driving unit. The cylinder may be implemented as an empty circular pillar with predefined thickness.

In one embodiment, the first and second cylinders 311 and 312 may be combined with a bolt. In another embodiment, the first and second cylinders 311 and 312 may be embodied as a single body.

In one embodiment, the fixing contact unit 310 may further include at least one pair of spring contact members 330. Each of the at least one pair of spring contact members 330 is entirely or partially subsided in the first and second cylinders 311 and 312. Each is configured to be in direct contact with the moving contact unit 320 to flow currents therethrough.

In one embodiment, the at least one pair of spring contact members 330 may include first and second spring contact pairs 331 and 332 in the first and second cylinders. The first spring contact pair 331 is fixed by subsidence inner of the first cylinder 311. The second spring contact pair 332 is fixed by subsidence outer of the second cylinder 312.

In one embodiment, the first and second spring contact pairs 331 and 332 may miss each other on the way. That is, a central axis of the first spring contact pair 331 may be not same with that of the second spring contact pair 332. When the first and second spring contact pairs 331 and 332 are missed, the fixing contact unit 310 may decrease its height.

In FIG. 3, the thickness t3 of the moving contact unit 320 may be smaller than the thickness t2 (FIG. 2) of the moving contact unit 230. That is, because both sides of the moving contact unit 320 may be in contact with the fixing contact unit 310, and a contact area is relatively larger, the thickness t3 may be relatively thinner in spite of the skin effects.

Figure 4:
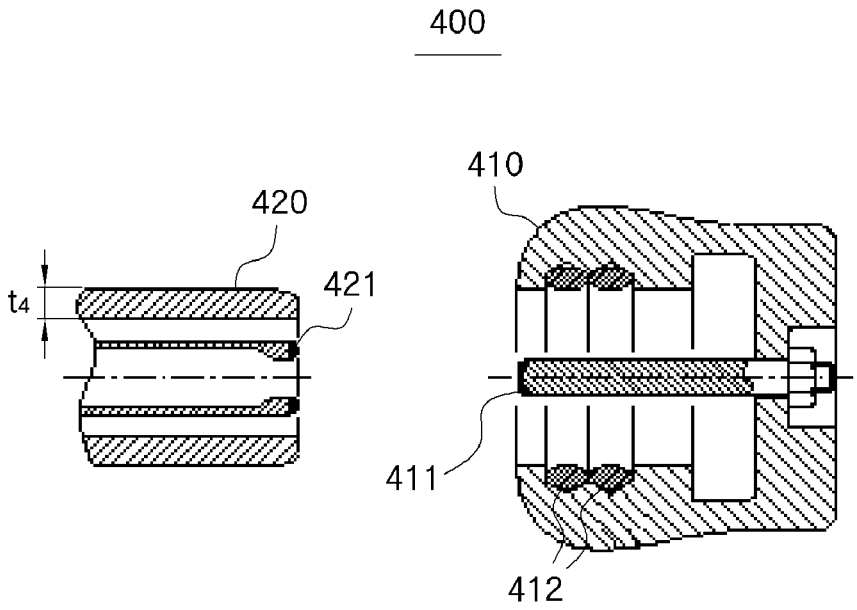
FIG. 4 is a sectional view illustrating a single structured contact used in a disconnecting switch.
Figure 5:
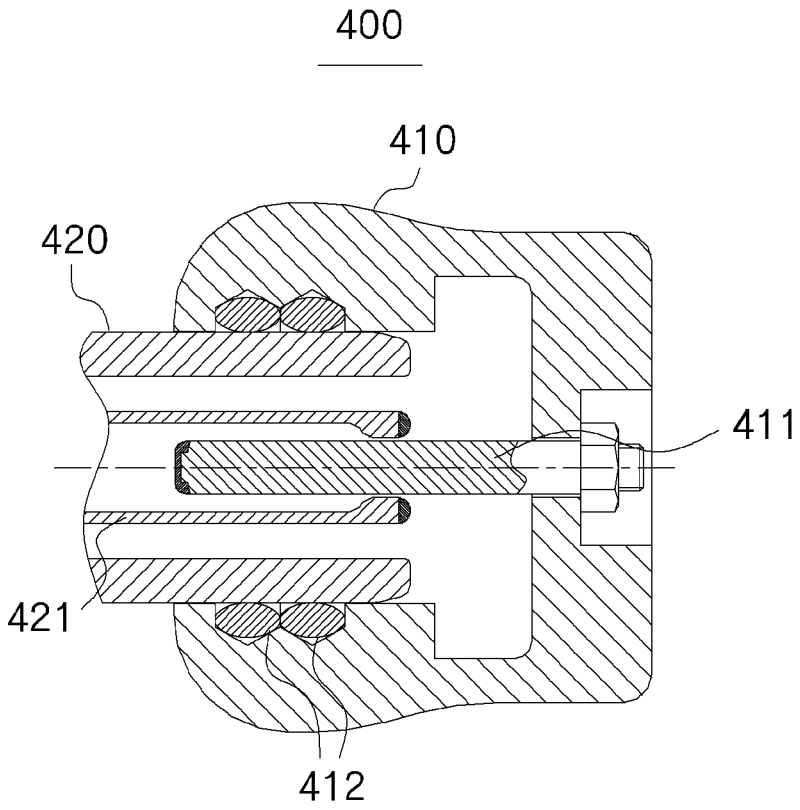
FIG. 5 is a sectional view illustrating a linkage of the single structured contact in FIG. 4.

FIG. 4 is a sectional view illustrating a single structured contact used in a disconnecting switch and FIG. 5 is a sectional view illustrating a linkage of the single structured contact in FIG. 4.

In FIGS. 4 and 5, the single structured contact 400 includes a fixing contact unit 410, a moving contact unit 420 and arching contact unit pairs 411 and 421.

The fixing and moving contact units 410 and 420 are described in FIG. 2. Therefore, more detail descriptions will be omitted here for the sake of brevity.

The arching contact unit pairs 411 and 421 may be respectively located in a center of the fixing and moving contact units 410 and 420.

Figure 6:
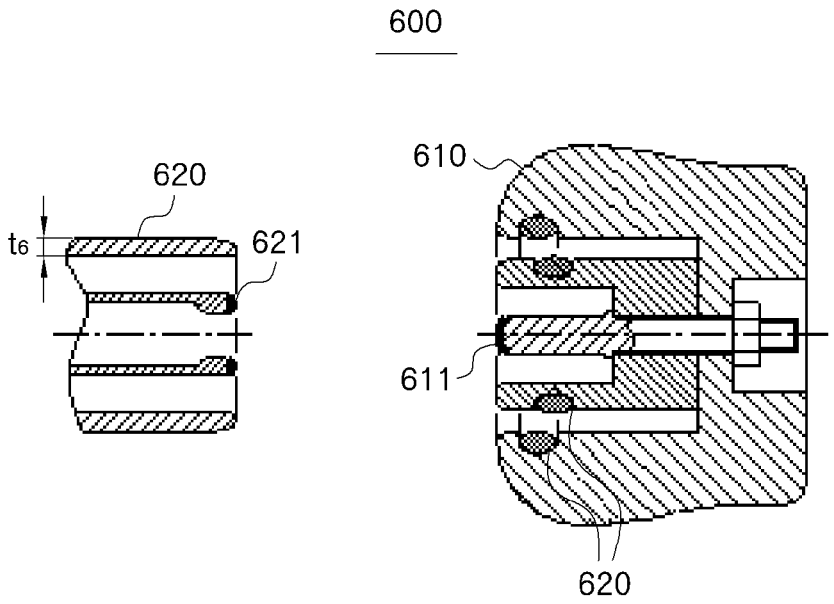
FIG. 6 is a sectional view illustrating a dual structured contact used in a disconnecting switch according to another example embodiment of the present invention.
Figure 7:
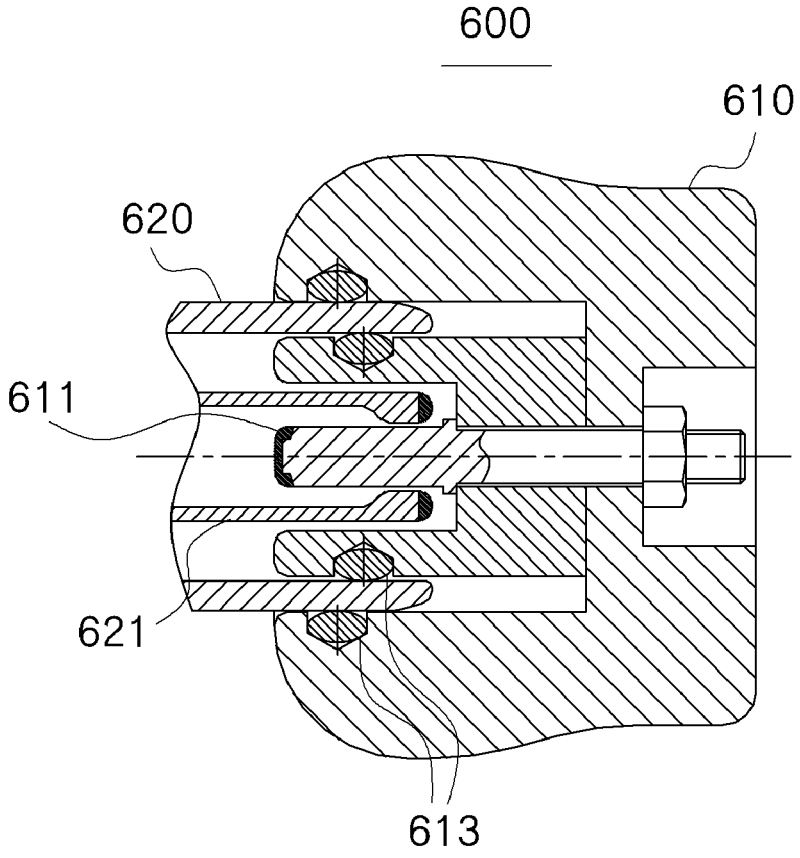
FIG. 7 is a sectional view illustrating a linkage of the dual structured contact in FIG. 6.

FIG. 6 is a sectional view illustrating a dual structured contact used in a disconnecting switch according to another example embodiment of the present invention, and FIG. 7 is a sectional view illustrating a linkage of the dual structured contact in FIG. 6.

In FIGS. 6 and 7, the dual structured contact 600 includes a fixing contact unit 610, a moving contact unit 620 and arching contact unit pairs 611 and 621.

The fixing and moving contact units 610 and 620 are described in FIG. 3. Therefore, more detail descriptions will be omitted here for the sake of brevity.

The arching contact unit pairs 611 and 621 may be respectively located in a center of the fixing and moving contact units 610 and 620. That is, the arching contact unit 611 may be projected from an inner cylinder of the fixing contact unit 610. In one embodiment, the arching contact unit 611 may be embodied into a bolt for a linkage between inner and outer cylinders of the fixing contact unit 610.

In FIGS. 6 and 7, the thickness and outside diameter of the dual structured contact 600 is smaller than those of the single structured contact 400. Also, the electric field strength of the fixing contact unit 610 is mitigated, and the size of the fixing contact unit 610 is relatively smaller.

A contact area of the dual structured contact 600 is increased and stableness for fault conditions such as short circuit currents is increased. Also, when the moving contact unit 620 is inserted into the fixing contact unit 610, the depth of the insertion may be shallower, the stroke of the moving contact unit 620 may be decreased, and the height of the fixing contact unit 610 may be decreased.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A dual structured contact for switchgear comprising:

a moving contact unit being formed of a conducting material, the moving contact unit including first and second terminals, the first terminal comprising a cylinder and the second terminal extending to a driving unit such that the moving contact unit moves back and forth by the driving unit; and a fixing contact unit being formed of a conducting material, the fixing contact unit including first and second cylinders being outside and inside of the fixing contact unit with a same axis, an inner part of the first cylinder being in contact with an outer part of the first terminal, and an outer part of the second cylinder being in contact with an inner part of the first terminal, wherein the fixing contact unit further includes:

a first spring contact pair fixed in the inner part of the first cylinder and being in direct contact with the outer part of the first terminal; and a second spring contact pair fixed in the outer part of the second cylinder and being in direct contact with the inner part of the first terminal.

2. The dual structured contact of claim 1, wherein a central axis of the first spring contact pair is a different axis than that of the second spring contact pair.

3. A switchgear comprising:

a disconnecting switch including a dual structured contact with a moving contact unit, a fixing contact unit, and a pair of arching contacts, wherein the moving contact unit is formed of a conducting material and the moving contact unit includes first and second terminals, the first terminal comprising a cylinder and the second terminal extending to a driving unit such that the moving contact unit moves back and forth by the driving unit, and wherein the fixing contact unit is formed of a conducting material and the fixing contact unit includes first and second cylinders being outside and inside of the fixing contact unit with a same axis, an inner part of the first cylinder being in contact with an outer part of the first terminal, and an outer part of the second cylinder being in contact with an inner part of the first terminal, wherein the fixing contact unit further includes:

a first spring contact pair fixed in the inner part of the first cylinder and being in direct contact with the outer part of the first terminal; and a second spring contact pair fixed in the outer part of the second cylinder and being in direct contact with the inner part of the first terminal.

4. The dual structured contact of claim 1, further comprising:

a pair of arching contacts including a first arching contact fixing the second cylinder to the first cylinder and having a contact rod positioned inside the second cylinder, and a second arching contact having a cylindrical shape and positioned inside the cylinder of the moving contact unit, wherein the second arching contact is inserted into an inside of the second cylinder and the first arching contact is inserted into an inside of the second arching contact.

5. The switchgear of claim 3, wherein the pair of arching contacts include a first arching contact fixing the second cylinder to the first cylinder and having a contact rod positioned inside the second cylinder, and a second arching contact having a cylindrical shape and positioned inside the cylinder of the moving contact unit, wherein the second arching contact is inserted into an inside of the second cylinder and the first arching contact is inserted into an inside of the second arching contact.

* * * * *